US010145167B1

(12) United States Patent
Wang

(10) Patent No.: US 10,145,167 B1
(45) Date of Patent: Dec. 4, 2018

(54) CLOSURE MEMBER WITH DECORATIVE PANEL

(71) Applicant: Nan Ya Plastics Corporation, Taipei (TW)

(72) Inventor: Kuei-Yung Wang, Taipei (TW)

(73) Assignee: NAN YA PLASTICS CORPORATION (TW)

( * ) Notice: Subject to any disclaimer, the term of this patent is extended or adjusted under 35 U.S.C. 154(b) by 0 days.

(21) Appl. No.: 16/054,021

(22) Filed: Aug. 3, 2018

Related U.S. Application Data

(63) Continuation of application No. 15/825,374, filed on Nov. 29, 2017.

(51) Int. Cl.
*E06B 3/58* (2006.01)
*E06B 3/70* (2006.01)

(52) U.S. Cl.
CPC ..... *E06B 3/5814* (2013.01); *E06B 3/5892* (2013.01); *E06B 2003/7023* (2013.01)

(58) Field of Classification Search
CPC ..... E06B 3/54; E06B 3/5814; E06B 3/5892
See application file for complete search history.

(56) References Cited

U.S. PATENT DOCUMENTS 4,720,951 A * 1/1988 Thorn ..... B29C 44/18 49/DIG. 2
6,574,935 B2 * 6/2003 Wang Chen ..... E06B 3/5892 52/204.62
6,619,005 B1 * 9/2003 Chen ..... E06B 3/5892 49/502
6,694,701 B2 2/2004 Wang
6,729,095 B2 5/2004 Wang Chen
7,430,836 B2 10/2008 Sibbett
7,721,501 B2 5/2010 Lynch et al.
7,997,040 B2 8/2011 Lynch
9,290,989 B2 3/2016 Lynch
9,624,714 B2 4/2017 Gouge
2007/0204546 A1 9/2007 Lynch et al.
2008/0209826 A1 9/2008 Hodges
2016/0060947 A1 * 3/2016 Wang ..... E06B 3/5892 52/455

FOREIGN PATENT DOCUMENTS

CA 2361321 A1 5/2003
GB 2539282 A1 12/2016
TW M517777 U 2/2016

* cited by examiner

*Primary Examiner* — Babajide A Demuren
(74) *Attorney, Agent, or Firm* — Ostrolenk Faber LLP

(57) ABSTRACT

A door panel comprises a body, first and second skins on opposite sides of the body, each having an opening aligned with the other opening, a first lip portion being provided on the first skin and adjacent the opening for holding a decorative panel and a pair of coupling elements provided on the first and second skins respectively and extending therebetween for inter-engagement to thereby fix relative positions of the first and second skins. The first and second skins define a space therebetween for receiving filling material to form the body, and include a partition in and extending across the space to delineate a portion of the space separate from the openings for receiving the filling material to form the body.

10 Claims, 9 Drawing Sheets

CLOSURE MEMBER WITH DECORATIVE PANEL

CROSS-REFERENCE TO RELATED APPLICATIONS

The present patent application is a continuation of prior U.S. patent application Ser. No. 15/825,374, filed Nov. 29, 2017, by Kuei-Yung WANG entitled "CLOSURE MEMBER WITH DECORATIVE PANEL". The contents of the patent application listed above is incorporated in full herein by reference.

The present invention relates to a closure member, for example a door, with improvement for gripping a decorative panel, such as particularly, but not exclusively, a glass panel.

BACKGROUND OF THE INVENTION

Commonly, a door may be provided with a glaze unit. The glaze unit may be for decorative purpose but more often to harvest the sunlight and allow observation of the environment outside of the door through the glaze unit from within.

Traditionally, beads are used to secure a glass panel to the opening of a door. The beads are usually replaceable piece(s) of wood that fasten onto the door panel through the action of connectors. The making and assembling of beads require extra steps that add to the overall manufacturing costs of the door.

Fiberglass door with glazed units are available. Beads are not required to secure the pane of glass to the door. The door includes outer and inner door skins which are provided with integrally formed lips for gripping onto the pane. Adhesive is used to bind the pane to the lips. The lips and the door skin are formed in a single step. The pane of glass is fixed to the door skin during the manufacturing of the door. No additional step is required after the door is made for assembling glass pane. However, the arrangement does not allow for replacement of the glass pane. There is very little flexibility for customization after the door leaves the factory.

The invention seeks to eliminate or at least to mitipartition such shortcomings by providing a door with improvement for gripping a decorative panel such as glass.

SUMMARY OF THE INVENTION

In a first aspect of the invention there is provided a door panel comprising a body; first and second skins on opposite sides of the body, each having an opening aligned with the other opening; a first lip portion being provided on the first skin and adjacent the opening for holding a glass panel; and a pair of coupling elements provided on the first and second skins respectively and extending therebetween for inter-engagement to thereby fix relative positions of the first and second skins; wherein the first and second skins define a space therebetween for receiving filling material to form the body, and include a partition in and extending across the space to delineate a portion of the space separate from the openings for receiving the filling material to form the body; preferably, the partition is part of and formed through inter-engagement of the coupling elements, more preferably, the first skin further includes a first coupling formation between the lip portion and the coupling element for engaging a second coupling formation; more preferably, the first lip portion includes a void for receiving an adhesive applicable to fix a glass panel in the opening; yet more preferably, the second skin includes a second lip portion adjacent the opening to cooperate with the first lip portion for holding a glass panel; it is preferable that the second lip portion includes a void for receiving an adhesive applicable to fix a glass panel in the opening; Advantageously, an indicating element is provided on an outer surface of the second skin adjacent the coupling element which extends from an inner surface of the second skin; more advantageously, the indicating element is formed along with the rest of the second skin in a same production step; more advantageously, the second lip portion is removable by way of severing along the indicator; yet more advantageously, the indicating element comprises a frangible portion; preferably, the indicating element comprises a groove; more preferably, the door panel includes a bead for extending adjacent the second skin to cooperate with the first lip portion for holding a said glass panel in the openings; more preferably, the door panel includes a bead for extending adjacent the second skin to cooperate with the first lip portion for holding a said glass panel in the openings, the bead including the second coupling formation for engagement with the first coupling formation, whereby the bead is secured; yet more preferably, a separate bead is provided in place of the second lip portion of the second skin for holding the glass panel in the openings; it is preferable that the second lip portion is one of an integral part and a separate part of the second skin; it is advantageously that the second lip portion is integrally connected to the second skin by means of a frangible connection which is breakable to separate the second lip portion from the second skin for replacement of the glass panel, with a replacement lip portion supplied with attachment means subsequently attached; more advantageously, the first skin further includes a first coupling formation between the lip portion and the coupling element for engaging a second coupling formation, and the attachment means comprises the second coupling formation; it is preferable that a stopper is provided between the void and the coupling element on the first skin to form a boundary marking the limits of an area for the glass panel, furthermore, an outer surface of the second skin may be free of any indication for removable of the second lip portion.

In a second aspect of the invention, there is provided a method of making the door panel as claimed in any one of claims 1 to 11, including the step of providing first and second mould parts along with interchangeable first and second mould inserts, and using of the first or second mould insert between the first and second mould parts in moulding of the second skin with or without the second lip portion respectively.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
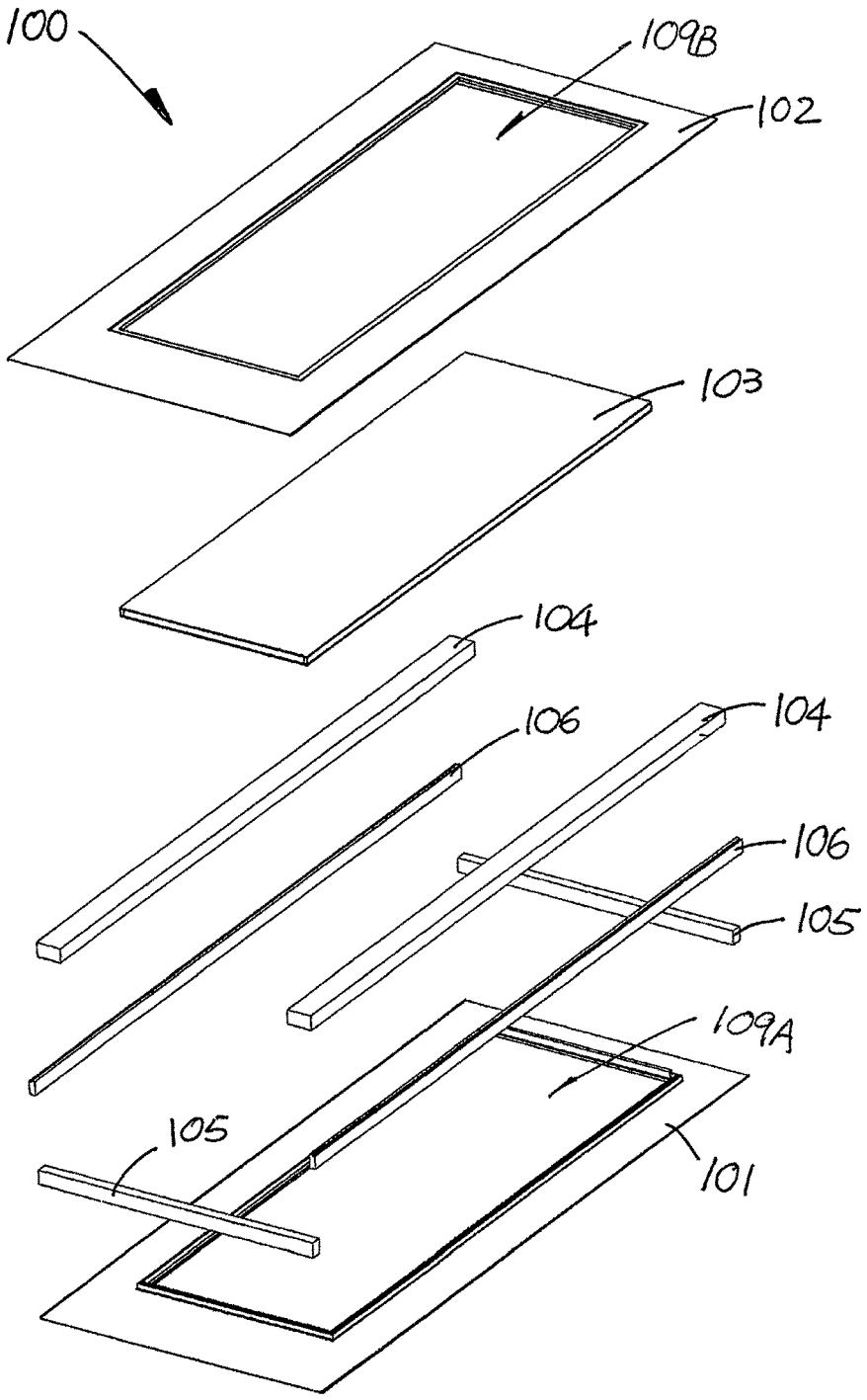
FIG. 1 is an exploded view of a first embodiment of a door of the invention.
Figure 2:
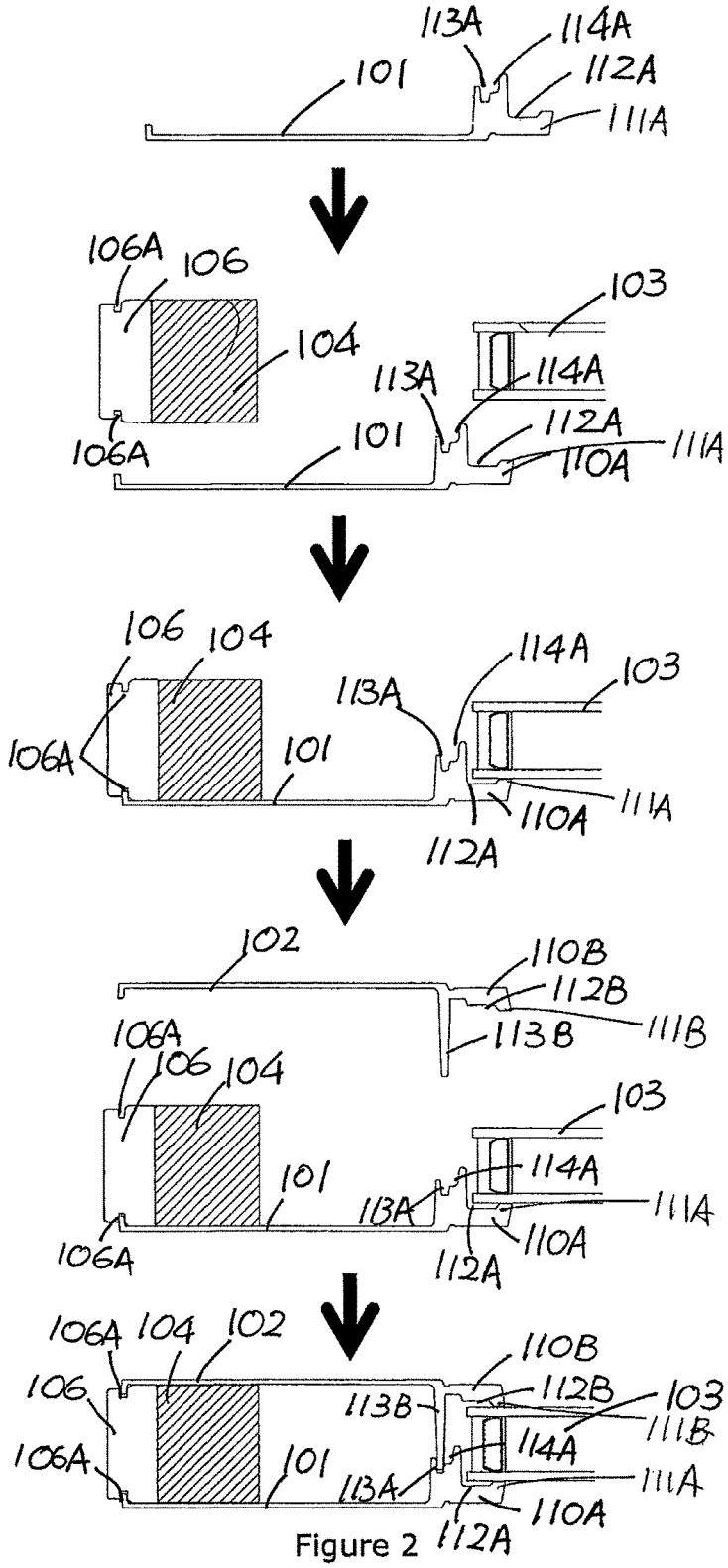
FIG. 2 is a series of cross-sectional views of parts of the door in FIG. 1 showing the sequential steps of assembling the same.
Figure 3:
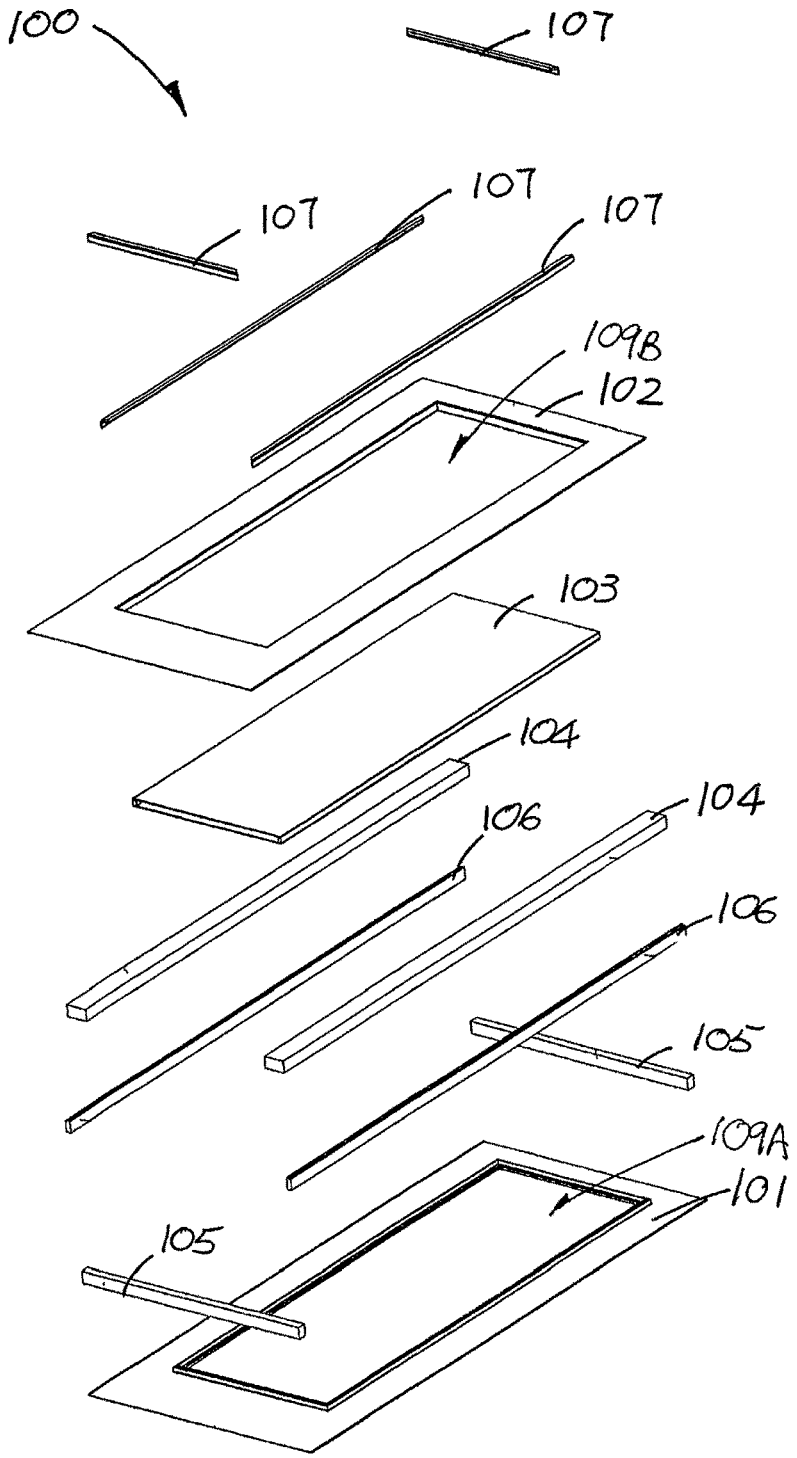
FIG. 3 is an exploded view of a second embodiment of the door of the invention.
Figure 4:
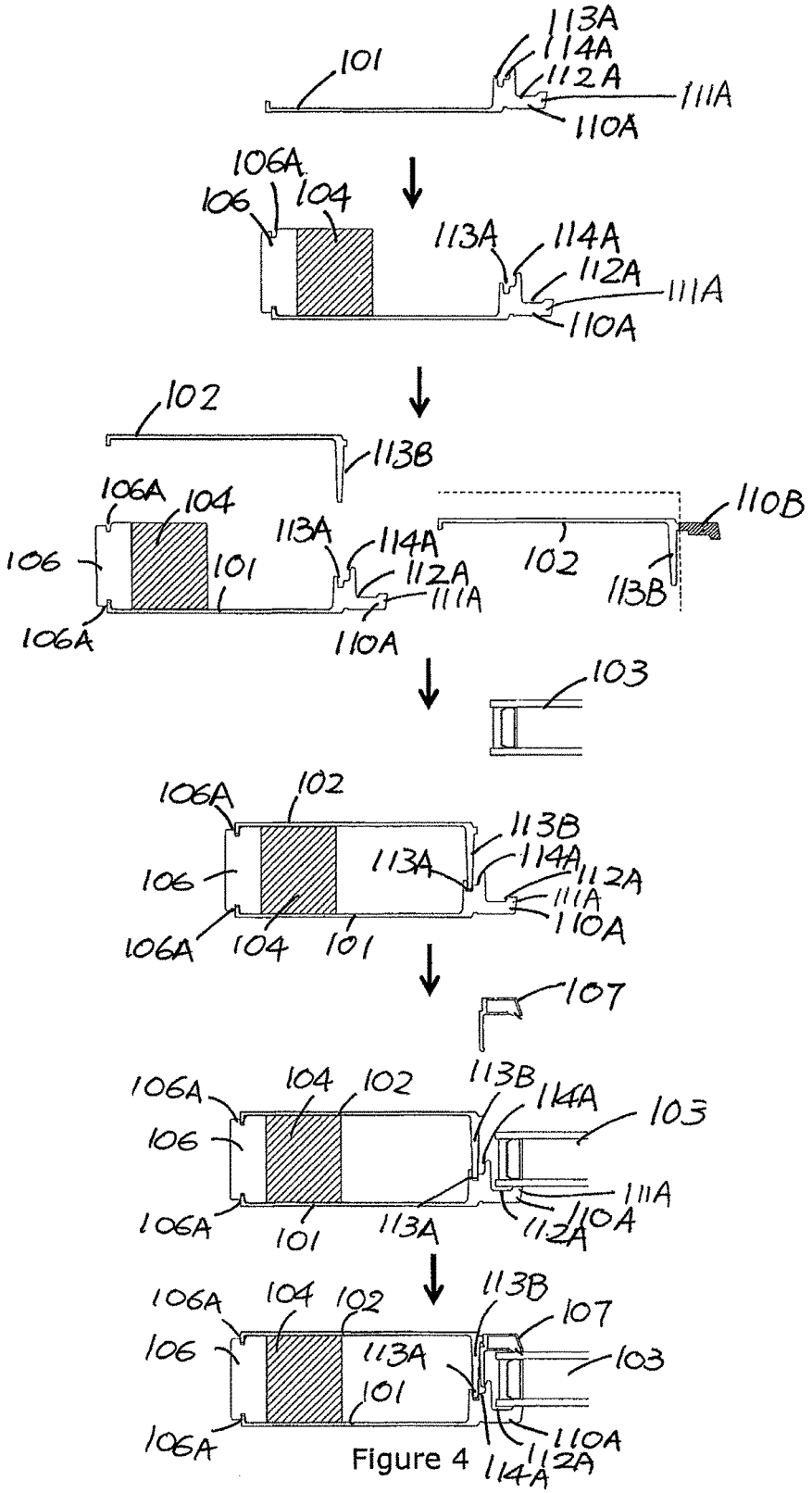
FIG. 4 is a series of cross-sectional views of parts of the door in FIG. 3 showing the sequential steps of assembling the same.
Figure 5A:
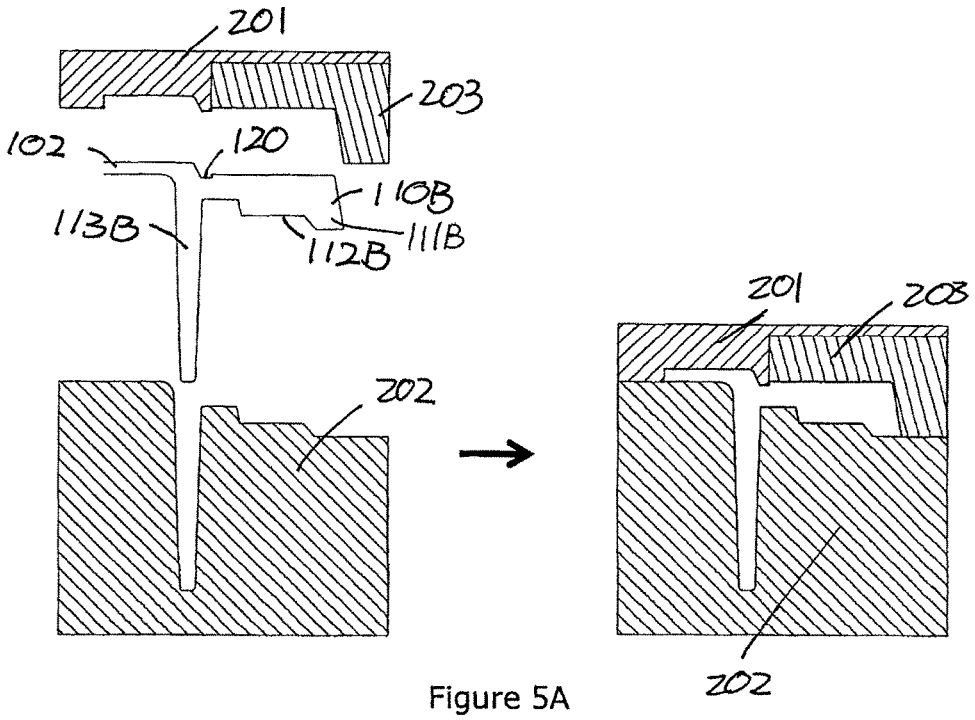
FIG. 5A is a series of cross-sectional view of a part of a mould for forming a part of the door in FIG. 1, showing the mould at two different stages of the formation.
Figure 5B:
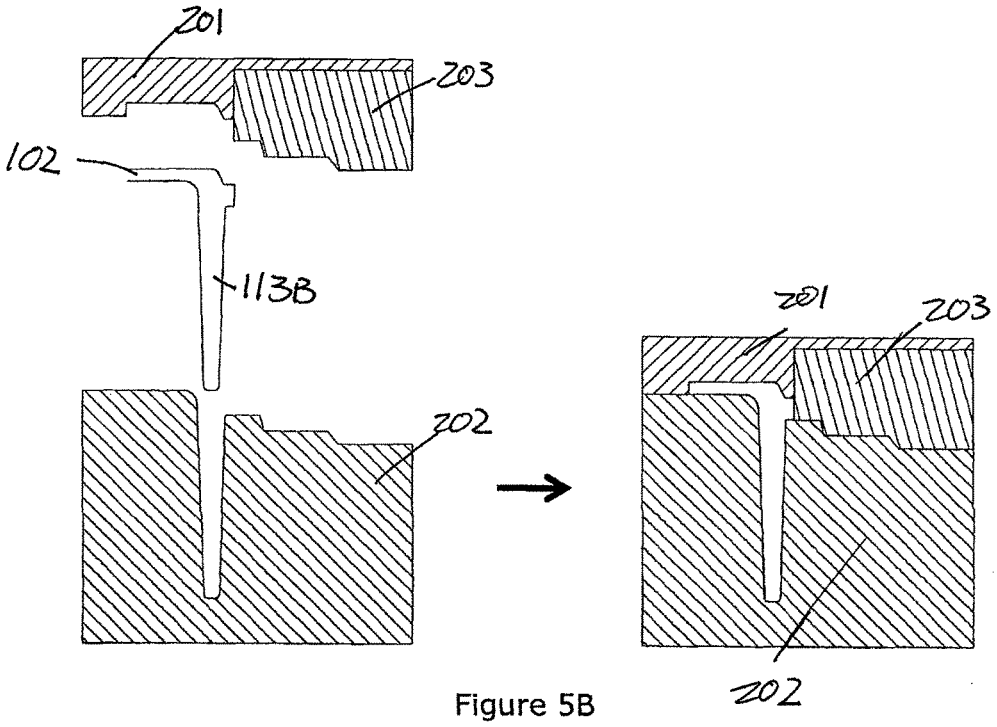
FIG. 5B is a series of cross-sectional view of a part of a mould for forming a part of the door in FIG. 3, showing the mould at two different stages of the formation.
Figure 6:
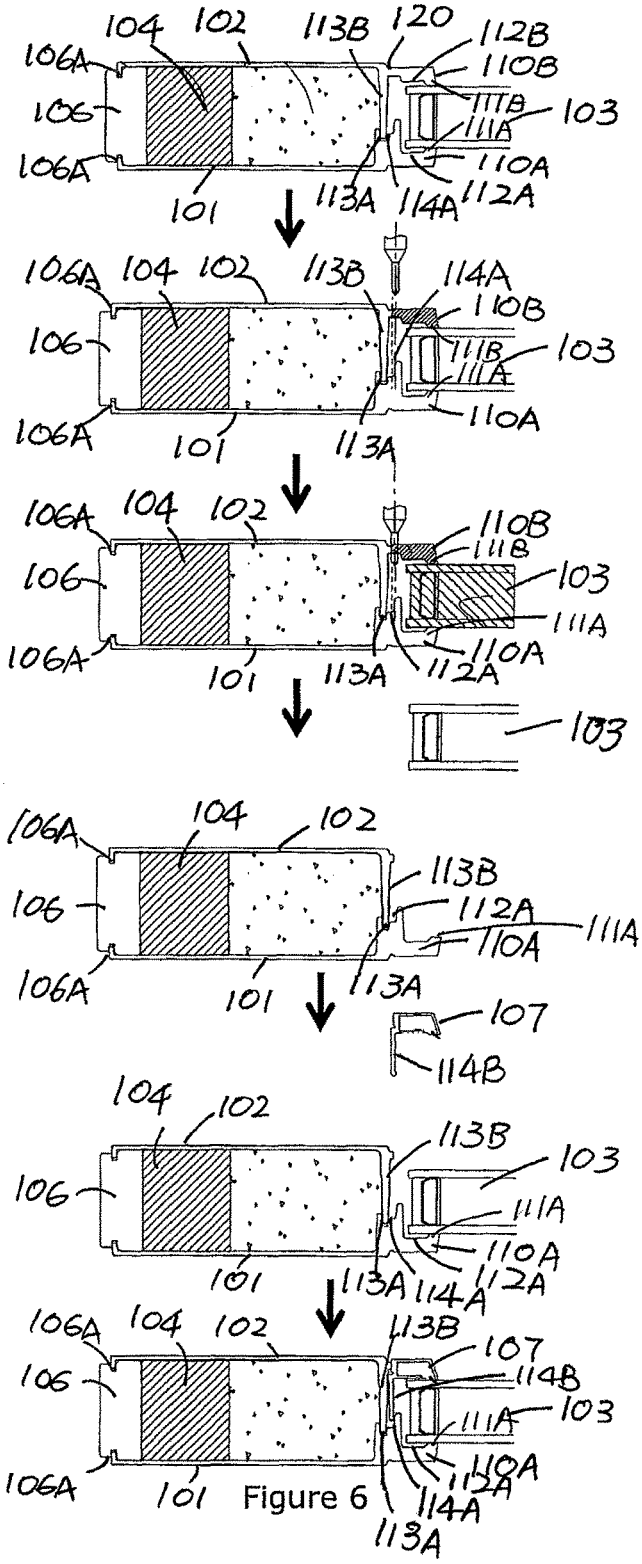
FIG. 6 is a series of cross-sectional views of parts of a third embodiment of the door of the invention, showing the sequential steps of assembling the same including the steps of replacing a lip with a bead.

FIGS. 1 to 7 show three embodiments of the invention. FIGS. 1 and 2 show the first embodiment of the invention, FIGS. 3 and 4 show the second embodiment and FIG. 6 show the third embodiment. The third embodiment may be understood as a combination of the first and second embodiment.

Referring to FIGS. 1 and 2 there is shown a door panel 100 in accordance with the invention. The door panel 100 includes front and rear door skins 101 and 102. The front skin 101 has an opening 109A which is aligned with a corresponding opening 109B on the rear skin 102. The two openings 109A and 109B are of the same size and shape for accommodating a same decorative panel in the form of a pane of glass/glass panel 103 which is sandwiched between the front and rear skins 101 and 102. To maintain spacing between the two skins 101 and 102, stiles 104 and rails 105 are provided at an outer region of the skins 101 and 102. The thickness of the stiles 104 and rails 105 define the height of the spacing which is filled with filling material, e.g. PU foam. The stiles 104 and rails 105 also offer reinforcement to the mechanical strength of the overall door panel 100. Covers 106 are provided on an outside of the stiles 104. A portion of the cover 106 is exposed to the external environment while the rest is sandwiched between the skins 101 and 102. Two pairs of couplers are useful in retaining the covers 106 to the skins 101 and 102. Outer ends of the front and rear skins 101 and 102 form a pair of jaws (male coupler) gripping onto respective grooves 106A (female coupler) on the covers 106.

With reference to FIG. 2, the skins 101 and 102 have respective lips 110A and 110B integrally formed thereto. The lips 110A and 110B delimit the respective openings 109A and 109B for accommodating the glass panel 103. The lips 110A and 110B are formed with the skins 101 and 102 in a same production step, e.g. moulding or extrusion. The lips 110A and 110B have respective gripping elements 111A and 111B provided adjacent the openings 109A and 109B for gripping onto an outer surface of the glass pane 103. These gripping elements 111A and 111B function as a pair of jaws. With adhesive being applied in respective voids 112A and 112B behind the gripping elements 111A and 111B, the glass panel 103 is fixed in position. A pair of couplers/coupling elements 113A and 113B is provided with the skins 101 and 102 behind the voids 112A and 112B. On one side, these complementary couplers 113A and 113B protrude into the spacing and are inter-engageable to form a partition that guards against the outflow of filling material into the voids 112A and 112B thereby preventing the filing material from contacting the glass panel 103. The partition is provided in and extends across the space to delineate a portion of the space separate from the openings for receiving the filling material to form the body. More specifically, the couplers 113A and 113B partitioned the spacing into two separate regions one for the filing material and the other for the glass panel 103. A stopper 115 is provided between the void 112A and the coupler 113A on the first skin 101 to form a boundary marking the limits of an area for the glass panel 103.

To assemble the door panel 100, the front skin 101 (or the outer skin) is laid down to receive the stiles 104, rails 105, the covers 106 and the glass panel 103. The rear skin 102 (or the inner skin) is placed on top thereby sandwiching the stiles 104, rails 105 and part of the covers 106 as well as part of the glass panel 103. Adhesive is applied to fix the relative position of the skins 101 and 102, the stiles 104, the rails 105, the covers 106 and the glass panel 103. The couplers 113A and 113B partitioned the spacing into a first region for the filing material and a second region in which the glass panel 103 is placed. Filling material is injected to fill the first region and is allowed to cure.

The front and rear skins 101 and 102 may be made by way of injection moulding or extrusion.

In the second embodiment of the invention as shown in FIGS. 3 and 4, beads 107 are used to secure the glass panel 103 to the door panel 100. The rear skin 102 (inner skin) of the second embodiment does not include lip 110B. Beads 107 are used in lieu of the lip 110B. As shown in FIG. 5B, during the formation of the rear skin 102, the mould is modified to prevent the formations of the lip 110B. Comparing to FIG. 5A which shows the formation of the rear skin 102 of the first embodiment, mould piece 203 is of a shape and size to define contour of the lip 110B with upper and lower mould parts 201 and 202. In FIG. 5B, mould piece 203 is replaced by a differently shaped and sized mould piece 204 that occupies all space between the mould parts 201 and 202 that is useful in the formation of the lip 110B. In addition to the complementary couplers 113A and 113B, a second pair of complementary couplers/coupling formations 114A and 114B is provided to fix the relative positions between the beads 107 and the lip 110B. Each bead 107 includes a male coupler e.g. in the form of a projection/a tongue 114B for inter-engaging with the female coupler 114A on the front skin (outer skin) 101. The second pair of couplers 114A and 114B that fixes the beads 107 to the front skin 101 is positioned closer to the voids 112A and 112B than the first pair of couplers 113A and 113B which fixes the relative position between the front and rear skins 101 and 102. The rest of the door panel 100 in the second embodiment is the same as that in the first embodiment. Noteworthy, the coupler part 114A is made available on the front skin (inner skin) 101 of the first embodiment as well. This could be considered as preparation for the third embodiment.

Figure 7:
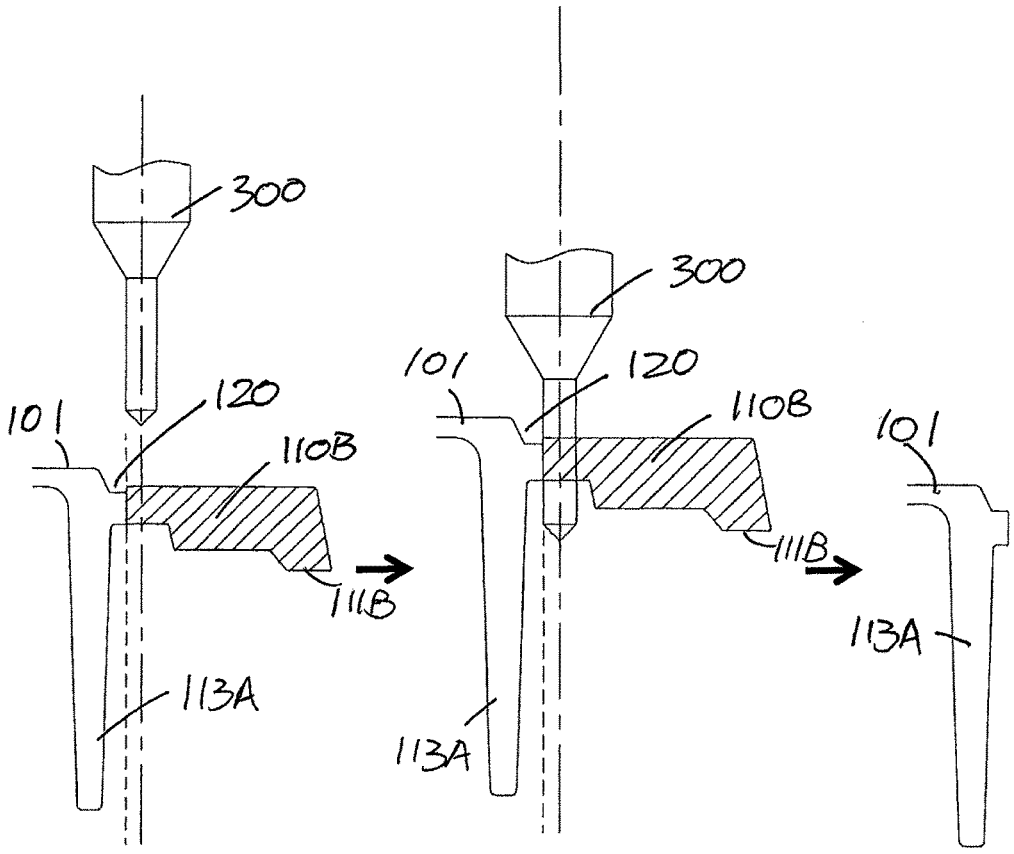
FIG. 7 is a series of enlarged cross-sectional views of a part of the door in FIG. 6, showing steps of a trimming process.

FIGS. 6 and 7 show the third embodiment of the invention. It is a combination of the first and second embodiments. When the situation calls for, the door panel 100 in the first embodiment is modified by removal of the lip 110B on the rear skin (inner skin) 102 with a cutting tool e.g. CNC 300. An indicator or a frangible portion, more specifically a groove 120 is provided on an outer surface/outside of the rear skin 102 visible by a user to identify a cutting line for the removal of the second lip 110B on the door panel 100. Such that when it is required for a replacement of the glass panel 103, e.g. in case of damage, the damaged glass panel 103 can be removed along with the lip 110B. The beads 107 are used instead of the lip 110B for fixing a new glass panel 103 to the door panel 100. Structurally the third embodiment is the same as the first embodiment in a first stage and transform into the second embodiment at a second stage. The groove 120 may be available in any of the three embodiments. In other words, the second lip portion 110B is integrally connected to the second skin 102 by means of a frangible connection 120 which is breakable to separate the second lip portion 110B from the second skin 102 for replacement of the decorative panel or glass panel 103, with a replacement lip portion in the form of a bead 107 supplied with attachment means such as the second coupling formation 114B subsequently attached.

Figure 8:
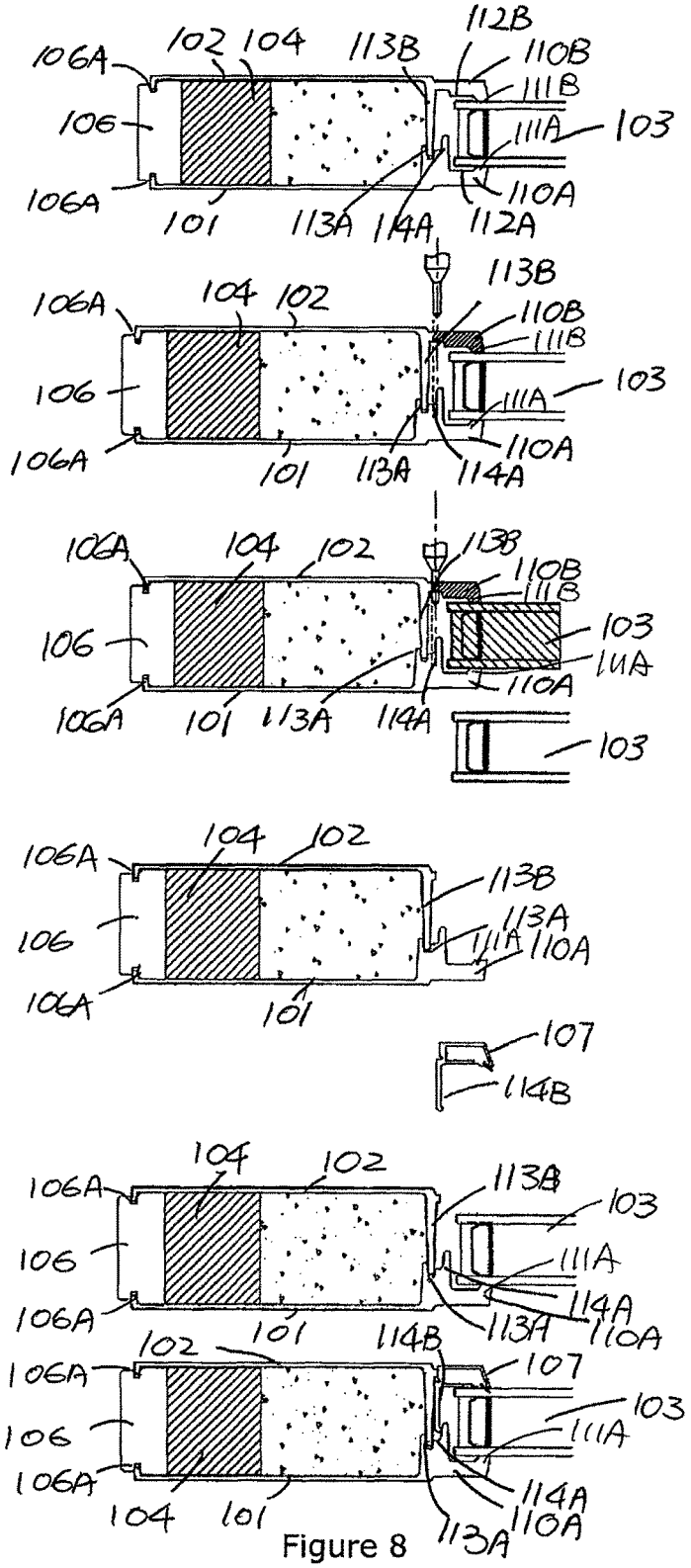
FIG. 8 is a series of cross-sectional views of a fourth embodiment of the door of the invention showing the sequential steps of assembling the same including the steps of replacing a lip with a bead.
Figure 9:
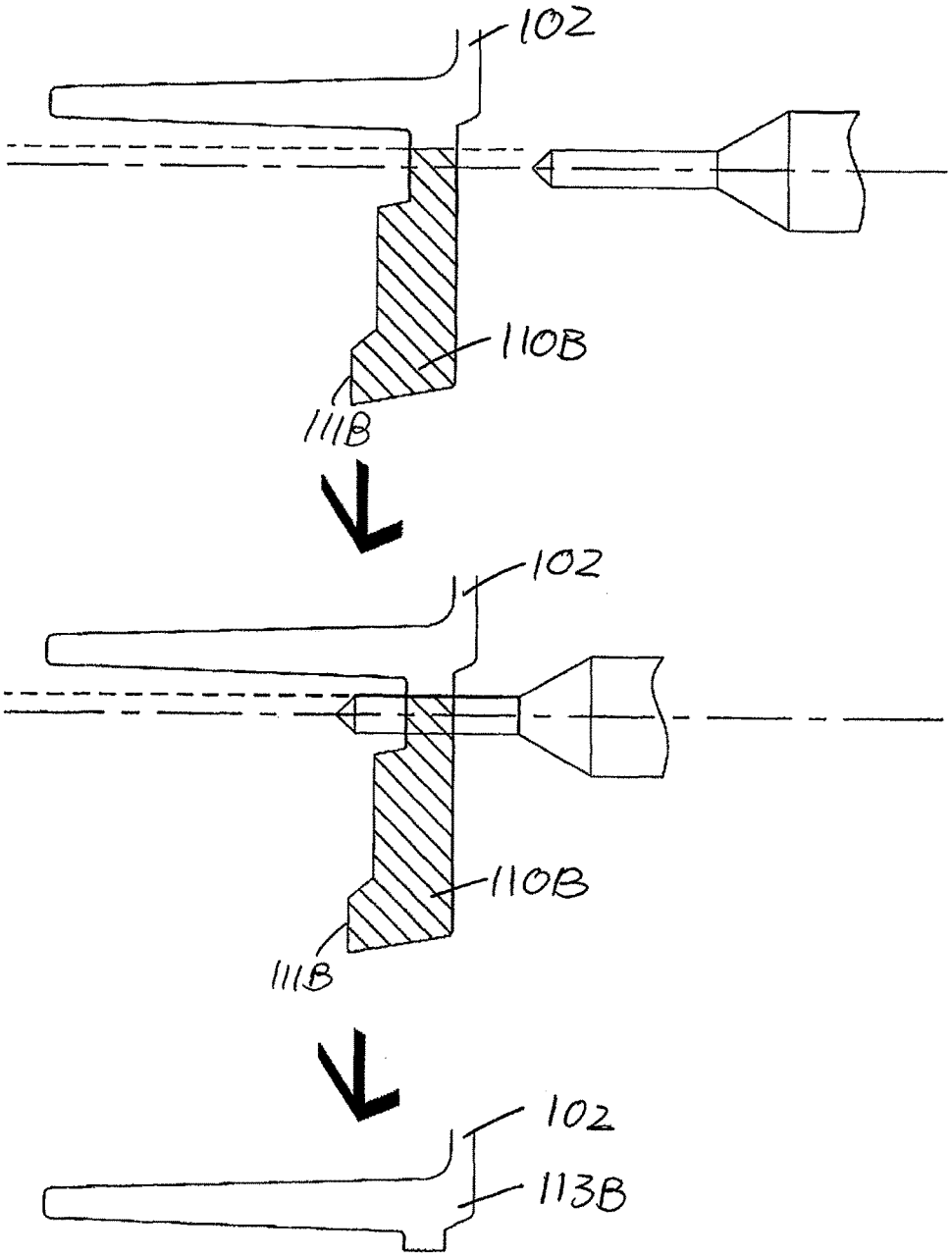
FIG. 9 is a series of enlarges cross-sectional views of a part of the door in FIG. 8, showing steps of a trimming process.

Referring to FIGS. 8 to 9, there is provided a fourth embodiment of the invention where no indicator 120 is provided on the rear skin (inner skin) 102 of the door panel 100. There is no frangible connection breakable for separating the second lip portion 110B from the second skin 102. A cutting tool is automated by means of computer executing pre-programmed sequence of machine control commands for performing the cutting procedure. Coordinates are provided to the computer for positioning the cutting tool and identifying the cut position. More specifically, computer numerical control (CNC) or numerical control (NC) is useful in determining the cut position and performing the cutting procedure. Any modification of this embodiment of the door panel 100 by way of replacing the second lip portion 110B with beads 107 is intended to be performed in the factory.

Referring to FIG. 8, a door panel 100 with glass panel 103 is provided as the starting point. The second lip portion 110B of the rear skin (Inner skin) 102 is trimmed using a CNC/NC cutter. No indicator is provided on the rear skin 102 to show the cut position. Once the second lip portion 110B is removed, beads 107 are provided to take the position of the second lip portion 110B for securing the same or a new glass panel 103. Adhesive is useful in securing the beads 107 while the first coupling formation 114*a* on the front skin 101 receives the second coupling formations 114B on the beads 107 for fixing the relative positions between the beads 107 and the skins 101 and 102.

The fourth embodiment of the door panel 100 is basically the same as that of the third embodiment except that it does not include an indicator.

The invention has been given by way of example only, and various other modifications of and/or alterations to the described embodiment may be made by persons skilled in the art without departing from the scope of the invention as specified in the appended claims.

The invention claimed is:

1. A door panel comprising:

a body having opposite sides;

first and second skins on the respective opposite sides of the body, the skins together defining outer dimensions of the door panel, each of the first and second skins having an opening through the skin, and the openings are aligned with each other;

a first lip portion provided on the first skin and adjacent a first of the openings, the first lip portion configured for holding a glass panel in the opening;

a second lip portion provided on the second skin, the second lip portion being configured to cooperate with the first lip portion for holding the glass panel in the openings between the first and second lip portions;

first and second coupling elements provided on the first and second skins respectively and extending between the skins for inter-engagement of the coupling elements to thereby fix relative positions of the first and second skins;

the first and second skins defining a space between the skins configured for receiving a filling material selected to form the body;

the skins including a partition in and extending across the space between the skins to delineate a portion of the space separated from the openings for receiving the filling material to form the body; the partition is part of and formed through inter-engagement of the coupling elements;

wherein the first lip portion and the first skin constitute a first integral one-piece structure that partially overlaps with the opening in the first skin;

the second lip portion and the second skin constitute a second integral one-piece structure that partially overlaps with the opening in the second skin, the first and second lip portions being located and configured for sandwiching a pane of glass between the first and second lip portions; and a first coupling formation is formed between the first coupling element and the first lip portion and is unused when the second lip portion and the second skin remain an integral one-piece structure, the first coupling formation being configured for engagement with a coupling element of a replacement lip portion configured for replacing the second lip portion.

2. A door panel according to claim 1, further comprising:

an indicating element is provided on an outer surface of the second skin adjacent the coupling element which extends from an inner surface of the second skin, and the second lip portion is removable by way of severing along the indicator.

3. A door panel according to claim 1, further comprising:

a bead for extending adjacent the second skin to cooperate with the first lip portion for holding a said glass panel in the openings.

4. A door panel according to claim 1, further comprising:

a bead for extending adjacent the second skin to cooperate with the first lip portion for holding a said glass panel in the openings, the bead including the second coupling formation for engagement with the first coupling formation, whereby the bead is secured; and the first skin further includes a first coupling formation between the lip portion and the coupling element for engaging a second coupling formation.

5. A door panel according to claim 2, further comprising:

a separate bead is provided in place of the second lip portion of the second skin for holding the glass panel in the openings.

6. A door panel according to claim 1, further comprising:

the second lip portion is a part of the second skin with its position being perceivable by a user when the second lip is integrally formed with the second skin and when the second lip portion is subsequently not integrally formed with the second skin.

7. A door panel according to claim 1, further comprising:

an outer surface of the second skin is free of any indication for removal of the second lip portion.

8. A door panel according to claim 1, further comprising:

the first coupling formation is engageable with a second coupling formation extending from the second lip portion when the second lip portion is subsequently not integrally formed with the second skin as a one-piece structure.

9. A door panel according to claim 8, further comprising:

the second lip portion which is subsequently not integrally formed with the second skin, cooperates with the first lip portion for holding a said glass panel in the openings.

10. A method of making a door panel, wherein the door panel comprises:

a body having opposite sides;

first and second skins on the respective opposite sides of the body, the skins together defining outer dimensions of the door panel, each of the first and second skins having an opening through the skin, and the openings are aligned with each other;

a first lip portion provided on the first skin and adjacent a first of the openings, the first lip portion configured for holding a glass panel in the opening;

a second lip portion provided on the second skin, the second lip portion being configured to cooperate with the first lip portion for holding the glass panel in the openings between the first and second lip portions;

first and second coupling elements provided on the first and second skins respectively and extending between the skins for inter-engagement of the coupling elements to thereby fix relative positions of the first and second skins;

the first and second skins defining a space between the skins configured for receiving a filling material selected to form the body;

the skins including a partition in and extending across the space between the skins to delineate a portion of the space separated from the openings for receiving the filling material to form the body; the partition is part of and formed through inter-engagement of the coupling elements;

wherein the first lip portion and the first skin constitute a first integral one-piece structure that partially overlaps with the opening in the first skin;

the second lip portion and the second skin constitute a second integral one-piece structure that partially overlaps with the opening in the second skin, the first and second lip portions being located and configured for sandwiching a pane of glass between the first and second lip portions;

a first coupling formation is formed between the first coupling element and the first lip portion and is unused when the second lip portion and the second skin remain an integral one-piece structure, the first coupling formation being configured for engagement with a coupling element of a replacement lip portion configured for replacing the second lip portion;

the method comprising:

the step of providing first and second mould parts along with interchangeable first and second mould inserts, and using of the first or the second mould insert between the first and second mould parts in moulding of the second skin with or without the second lip portion respectively.

* * * * *